US010954012B2

(12) United States Patent
Draghetti

(10) Patent No.: US 10,954,012 B2
(45) Date of Patent: Mar. 23, 2021

(54) METHOD AND APPARATUS TO FEED AND FORM ORGANIZED GROUPS OF SMOKING ARTICLES

(71) Applicant: I.M.A. INDUSTRIA MACCHINE AUTOMATICHE S.P.A., Ozzano dell'Emilia (IT)

(72) Inventor: Fiorenzo Draghetti, Ozzano dell'Emilia (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 130 days.

(21) Appl. No.: 16/091,511

(22) PCT Filed: Apr. 3, 2017

(86) PCT No.: PCT/EP2017/057899
§ 371 (c)(1),
(2) Date: Oct. 4, 2018

(87) PCT Pub. No.: WO2017/174531
PCT Pub. Date: Oct. 12, 2017

(65) Prior Publication Data

US 2019/0127097 A1 May 2, 2019

(30) Foreign Application Priority Data

Apr. 4, 2016 (IT) ..... 102016000034339

(51) Int. Cl.
*B65B 19/32* (2006.01)
*B65B 19/04* (2006.01)
(Continued)

(52) U.S. Cl.
CPC ..... *B65B 19/32* (2013.01); *B65B 19/04* (2013.01); *B65B 19/28* (2013.01); *B65B 35/405* (2013.01);
(Continued)

(58) Field of Classification Search
CPC ..... B65B 19/32; B65B 19/04; B65B 19/28; B65B 35/405; B65B 39/007; B65B 57/14; B65B 2210/10
See application file for complete search history.

(56) References Cited

U.S. PATENT DOCUMENTS 1,539,745 A * 5/1925 Kerlin ..... B65B 19/10 53/529
1,765,820 A * 6/1930 Bronander ..... B65B 19/10 53/151
(Continued)

FOREIGN PATENT DOCUMENTS

EP 0243662 A2 11/1987
EP 1160164 A1 12/2001
(Continued)

OTHER PUBLICATIONS

International Search Report and Written Opinion for PCT/EP2017/057888, dated May 11, 2017.
(Continued)

*Primary Examiner* — Nathaniel C Chukwurah
*Assistant Examiner* — Lucas E. A. Palmer
(74) *Attorney, Agent, or Firm* — Marshall, Gerstein & Borun LLP

(57) ABSTRACT

Method to feed and form organized groups of smoking articles, providing to feed a plurality of pockets of a transfer conveyor with pockets moved step-wise, thrusting said organized groups of smoking articles, by means of thrusters actuated independently from each other, in a direction of
(Continued)

transfer and through respective forming drawers, into said pockets on the basis of a predefined production rhythm. The method provides, in the event of obstruction, stoppage or blockage of a forming drawer, to vary the operating speed of the thrusters associated with the other forming drawers in coordination and in synchrony with the step-wise feed speed of said transfer conveyor with pockets, in order to obtain an effective production rhythm equal or near to said predefined production rhythm.

14 Claims, 4 Drawing Sheets

(51) Int. Cl.
*B65B 35/40* (2006.01)
*B65B 39/00* (2006.01)
*B65B 57/14* (2006.01)
*B65B 19/28* (2006.01)

(52) U.S. Cl.
CPC ..... *B65B 39/007* (2013.01); *B65B 57/14* (2013.01); *B65B 2210/10* (2013.01)

(56) References Cited

U.S. PATENT DOCUMENTS 2,334,142 A * 11/1943 Arelt ..... B65B 19/10 53/149
2,551,199 A * 5/1951 Basus ..... B65B 19/10 53/150
2,829,476 A * 4/1958 Engleson ..... B65B 35/405 53/532
3,106,282 A * 10/1963 Schmermund ..... B65B 19/10 198/418.1
3,403,493 A * 10/1968 Heinz ..... B65B 19/10 53/151
3,426,503 A * 2/1969 Sherrill ..... B65B 19/24 53/529
3,435,940 A * 4/1969 Seragnoli ..... B65B 19/10 198/418.3
3,722,172 A * 3/1973 Seragnoli ..... B65B 19/28 53/54
3,735,767 A * 5/1973 Kruse ..... B65B 19/226 131/283
3,771,279 A * 11/1973 Seragnoli ..... B65B 19/10 53/56
3,772,848 A * 11/1973 Rudszinat ..... B65B 19/245 53/438
3,869,035 A * 3/1975 Focke ..... B65B 19/10 53/151
3,917,049 A * 11/1975 Shirai ..... B65B 19/04 198/448
3,924,386 A * 12/1975 Schmermund ..... B65B 11/32 53/136.4
4,079,575 A * 3/1978 Focke ..... B65B 11/30 53/148
4,096,938 A * 6/1978 Payne ..... B65B 19/04 414/790.3
4,112,651 A * 9/1978 Bardenhagen ..... B65B 19/20 53/170
4,164,278 A * 8/1979 Gurioli ..... B65B 19/04 198/468.1
4,183,191 A * 1/1980 Focke ..... B65B 11/30 53/222
4,207,720 A * 6/1980 Tolasch ..... A24C 5/354 221/200
4,209,955 A * 7/1980 Seragnoli ..... B65B 19/32 131/280
4,528,801 A * 7/1985 Seragnoli ..... B65B 19/32 53/150
4,607,477 A * 8/1986 Hinchcliffe ..... B65B 19/225 53/135.2
4,646,938 A * 3/1987 Focke ..... B65B 19/04 221/175
4,700,825 A * 10/1987 Mattei ..... B65B 19/10 198/418.3
4,735,032 A * 4/1988 Focke ..... B65B 19/04 198/418.3
4,907,608 A * 3/1990 Focke ..... B65B 19/30 131/282
4,964,501 A * 10/1990 Hoffmann ..... B65B 19/10 198/418.3
5,170,877 A * 12/1992 Francioni ..... B65G 43/08 198/347.3
5,540,034 A * 7/1996 Focke ..... B65B 19/20 53/150
5,769,205 A * 6/1998 Belvederi ..... B65B 19/04 198/474.1
5,782,334 A * 7/1998 Parrocchetti ..... B65B 19/10 198/418.1
5,822,952 A * 10/1998 Boldrini ..... B65B 19/105 53/444
5,979,458 A * 11/1999 Meis ..... B65B 19/10 131/105
6,269,931 B1 * 8/2001 Tale' ..... B65B 19/10 198/418.3
6,385,947 B2 * 5/2002 Meis ..... B65B 19/10 53/148
6,397,559 B1 * 6/2002 Focke ..... B65B 19/10 53/150
6,612,093 B1 * 9/2003 Grossmann ..... B65B 19/22 53/148
6,698,158 B2 * 3/2004 Spatafora ..... B65B 19/10 53/151
7,059,478 B2 * 6/2006 Spatafora ..... B65B 19/30 131/282
7,216,755 B2 * 5/2007 Focke ..... B65B 19/04 131/283
9,090,366 B2 * 7/2015 Draghetti ..... B65B 11/16
9,975,706 B2 * 5/2018 Lena ..... B65B 19/10
2001/0047923 A1 * 12/2001 Spatafora ..... B65B 19/04 198/418.6
2002/0020606 A1 * 2/2002 Spatafora ..... B65B 57/14 198/418
2005/0126115 A1 * 6/2005 Battisti ..... B65B 57/14 53/53
2005/0204706 A1 * 9/2005 Spirito ..... B65B 19/10 53/444

FOREIGN PATENT DOCUMENTS

EP 1184285 A2 3/2002
EP 1544110 A1 6/2005
EP 1580129 A1 9/2005
JP H08133223 A 5/1996

OTHER PUBLICATIONS

International Search Report and Written Opinion for PCT/EP2017/057899, dated May 24, 2017.

* cited by examiner 10
11
12
13
14
16
16a
17
18
19
20
21
22
24
25
26
26a
26b
28
36
36a
37
40
41
D
F
G
R

METHOD AND APPARATUS TO FEED AND FORM ORGANIZED GROUPS OF SMOKING ARTICLES

FIELD OF THE INVENTION

Embodiments described here concern a method and an apparatus to feed and form organized groups of smoking articles.

In particular, embodiments described here concern the transfer, feed and formation of organized groups of smoking articles, such as for example cigarettes, cigars, cigarillos or suchlike, to make packets of smoking articles, to obtain organized groups of smoking articles inside a single packet.

BACKGROUND OF THE INVENTION

Packaging machines are known, provided with apparatuses for feeding cigarettes, which supply organized groups of cigarettes to transfer conveyors with pockets, for example linear or wheel-type conveyors, to transfer packets, driven step-wise, from which they are transferred to other packaging devices or packet-making machines.

These known feed apparatuses comprise a feed unit, generally provided with a loading hopper into which the cigarettes to be disposed in organized groups are conveyed, defining a so-called cigarette store. The hopper generally has a plurality of vertical exits, or conduits, along which the cigarettes move downward due to the force of gravity, to form a column on a lower stop plate. A bottom portion of the column of cigarettes that has formed is defined by an organized group of cigarettes that will define the content of a packet and that are associated with a respective lateral exit aperture of a conduit. A thrust unit is also provided to transfer the organized groups of cigarettes from the cigarette store to suitable pockets associated with the transfer conveyors with pockets, from which they are transferred to the subsequent packet-making machines configured to make the packets.

By means of the thrust unit, each group of cigarettes is transferred, through the lateral exit aperture and a connected transfer device, to a respective pocket of the transfer conveyors with pockets driven step-wise, so as to position, with every step, an empty pocket with its entrance facing a respective transfer device, receiving its content on each occasion. The transfer device is therefore provided to connect the cigarette store, in a direction of feed of the cigarettes, where the cigarettes are fed in a column as described above, to the pockets of the transfer conveyor. The organized groups of cigarettes are made to pass, with an alternate thrust, through the transfer device so as to reach, as we said, the respective pockets of the transfer conveyor or wheel, driven step-wise.

During the transfer of the cigarettes, a blockage may occur, due for example to an incorrect positioning of the cigarettes, which normally requires an intervention to clean and free the blocked areas. The blockage can occur for example inside the transfer device.

One of the main disadvantages of blockage of cigarettes during transfer to a respective pocket of the transfer conveyors with pockets is that the productivity of the packaging machine can be decreased.

Moreover, in order for the blockage of cigarettes to be freed and the transfer device to be cleaned, generally a manual intervention of an operator is required, with possible safety risks deriving from the presence of moving parts, and also the possible waste of time that these manual operations entail, to the detriment of productivity.

The state of the art, therefore, suffers of the shortcoming of loss of productivity in case of blockage of the cigarettes during transfer to a respective pocket of the transfer conveyors.

Moreover, the known state of the art does not meet the requirement of cleaning the blockage of cigarettes, quickly, efficiently and safely, without requiring the manual intervention of an operator, for example in the transfer device that connects the cigarette store to the pockets.

There is therefore a need to perfect a method and an apparatus to feed and form organized groups of smoking articles, which can overcome at least one of the disadvantages of the state of the art.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

Embodiments described herein concern a method to feed and form organized groups of smoking articles. According to one embodiment, the method provides to feed a plurality of pockets of a transfer conveyor with pockets moved step-wise, thrusting the organized groups of smoking articles, by means of thrusters actuated independently from each other, in a direction of transfer and through respective forming drawers, into the pockets on the basis of a predefined production rhythm. According to some embodiments, the method provides, in the event of obstruction, stoppage or blockage of a forming drawer, to vary the operating speed of the thrusters associated with the other forming drawers in coordination and in synchrony with the step-wise feed speed of the transfer conveyor with pockets, in order to obtain an effective production rhythm equal or near to the predefined production rhythm.

According to embodiments, said variation of the operating speed of the thrusters is performed at least during the period when the specific blocked forming drawer does not supply groups of cigarettes to the transfer conveyor with pockets.

According to further embodiments, said variation of the operating speed of the thrusters provides to increase the speed at which the cigarettes are fed and transferred, by means of the thrusters not affected by the blockage of the specific blocked forming drawer.

According to still further embodiments, a signal of obstruction, stoppage or blockage in a forming drawer is generated by a sensor in the event of obstruction, stoppage or blockage of a forming drawer, wherein said signal is received by an electronic system controller commanding and controlling said variation in the movement of the thrusters.

According to yet further embodiments, said variation of the operating speed of the thrusters is provided until the blocked forming drawer is cleaned.

According to a possible embodiment, the method provides, in the event of obstruction, stoppage or blockage, to start a cleaning cycle of the forming drawer affected.

According to further embodiments, said forming drawer has an upper wall and a bottom wall, wherein said is comprised forming drawer in a transfer device provided, in a first condition of use, to transfer smoking articles in a direction of transfer from a feed store to a transfer conveyor with pockets f an apparatus to feed and form organized groups of smoking articles, wherein said cleaning cycle provides to activate a second maintenance condition of said transfer device in which the upper wall of said forming drawer is kept in a fixed position and at least the bottom wall of said forming drawer is automatically opened to allow the removal of smoking articles from said forming drawer.

According to further embodiments, the smoking articles, in the first condition of use, move in said direction of transfer in a passage channel provided inside said forming drawer, wherein said passage channel is kept aligned to said direction of transfer both in the first condition of use and in the second maintenance condition.

According to further embodiments, in said second maintenance condition, at least one of the lateral walls delimiting laterally said passage channel is automatically moved laterally toward the outside with respect to the passage channel, in a direction of movement transverse to the direction of transfer.

According to still further embodiments, in said second maintenance condition, at least after the bottom wall has been opened, a thruster of smoking articles is activated for a cleaning travel inside the passage channel.

According to yet further embodiments, in said maintenance condition, at least after the bottom wall has been opened, a jet of compressed air is introduced inside the passage channel.

According to still further embodiments, an apparatus to feed and form organized groups of smoking articles is provided. According to one embodiment, the apparatus comprises: a transfer conveyor with pockets moved stepwise and provided with a plurality of pockets, forming drawers associated with said pockets, a plurality of thrusters configured to be actuated independently from each other, in order to thrust said organized groups of smoking articles, thus feeding said groups of smoking articles, in a direction of transfer and through respective forming drawers, into said pockets on the basis of a predefined production rhythm, an electronic system controller configured for commanding and controlling, in the event of obstruction, stoppage or blockage of a forming drawer, a variation of the operating speed of the independently actuated thrusters associated with the other forming drawers in coordination and in synchrony with the step-wise feed speed of said transfer conveyor with pockets, in order to obtain an effective production rhythm equal or near to said predefined production rhythm.

According to possible embodiments, the apparatus comprises dedicated actuators each configured to independently actuate one specific thruster. Advantageously, the electronic system controller is configured for commanding and controlling the variation of the operating speed of the independently actuated thrusters, by controlling the respective dedicated actuators.

These and other aspects, characteristics and advantages of the present disclosure will be better understood with reference to the following description, drawings and attached claims. The drawings, which are integrated and form part of the present description, show some forms of embodiment of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
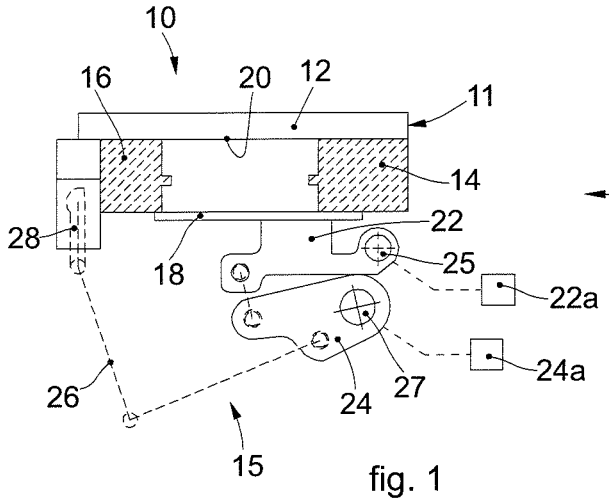
FIG. 1 is a schematic front view of a transfer device according to embodiments described here in a first condition of use.

We shall now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

We must point out here that smoking articles that can be provided in association with the embodiments described here are for example cigarettes, cigars, cigarillos or suchlike. Hereafter, for the purposes of the description of the present embodiments, we will refer to cigarettes, indicated by the reference number 13 in the attached drawings, as possible smoking articles, without excluding other possible smoking articles as given by way of example above.

Embodiments described here, using FIGS. 1-12, concern a transfer device 10 for cigarettes 13 configured to transfer cigarettes from a feed store 35 to a transfer conveyor with pockets 34 of an apparatus 30 to feed and form organized groups of cigarettes 13.

Furthermore, embodiments described here also concern an apparatus 30 to feed and form organized groups of smoking articles, in particular, cigarettes 13, comprising said transfer device 10.

According to some embodiments, the apparatus 30 can typically include a feed store 35 configured to feed cigarettes 13 and a transfer conveyor with pockets 34, configured to receive organized groups 19 of cigarettes 13 defining the content of a single packet to be formed. The apparatus 30 is configured to define a direction of transfer F of the cigarettes, from the feed store 35 to the transfer conveyor with pockets 34.

In possible implementations, the transfer conveyor with pockets 34 can be a transfer wheel, disposed vertical and configured to rotate around a horizontal axis of rotation, which during use is parallel with the direction of transfer F. The transfer wheel can be made to rotate step-wise. In this specific case, the transfer wheel can be radially equipped with pockets able to receive groups 19 of cigarettes 13, to be subsequently packed.

In other possible implementations, the transfer conveyor with pockets 34 can be a conveyor of the linear type, provided with pockets.

In some embodiments, the feed store 35 typically includes a loading hopper 44, into which the cigarettes 13 to be arranged in organized groups 19 are conveyed. The loading hopper 44 generally has a plurality of vertical exits, or conduits, along which the cigarettes 13 move downward due to the force of gravity, until they form respective columns of cigarettes 46, on a lower stop plate. A bottom portion of each of the columns of cigarettes 46 that has formed is defined by an organized group 19 of cigarettes 13 that will define the content of the packet and are facing a respective lateral exit aperture of a conduit.

A feed unit 32 is also provided, comprising a thrust unit 40 to transfer the organized groups 19 of cigarettes 13 from the feed store 35 to suitable pockets 36 (see FIGS. 3, 7 and 8 for example), associated with the transfer conveyor with pockets 34, from which they are transferred to the subsequent packaging or packet-making machines configured to make the packets.

In possible implementations, a base 42 is provided, to support the thrust unit 40. The thrust unit 40 can be provided with one or more thrusters 41, each configured to be driven with alternate motion to thrust a respective group 19 of cigarettes 13 that is formed on the bottom of the loading hopper 44 for each of the columns of cigarettes 46.

In some embodiments, combinable with all the embodiments described herein, a specific and dedicated actuator 48 is provided (see FIGS. 10*b*, 11*b* and 12 for example), to actuate a desired linear and alternate movement of each thruster 41, independently of the other thrusters 41. Advantageously, in embodiments, combinable with all the embodiments described herein, the independent movement by the respective actuators 48 of each thruster 41 can be coordinated, for example by means of an electronic control or electronic system controller 37 (see e.g. FIGS. 3, 6, 7, 8, 10*b*, 11*b*, 12), with the movement of the other thrusters 41 and also with the step-wise movement of the transfer conveyor with pockets 34, according to the program of the work cycle of the apparatus 30 and the packaging or packet-making machines downstream. An actuator to move a respective thruster 41 according to some embodiments described herein, combinable with all the embodiments described herein, can include a drive member, examples of which are given hereafter in the description. The actuator can be intrinsically linear or provide the conversion from a circular movement to a linear one, according to examples of the conversion mode supplied hereafter.

According to embodiments, by means of the thrust unit 40, and in particular the respective associated thrusters 41, each group 19 of cigarettes 13 can thus be transferred, through the lateral exit aperture of each conduit and the connected transfer device 10, into a respective pocket 36 of the transfer conveyor with pockets 34.

Embodiments in which the thrusters 41 can be actuated independently from each other can be used for instance in combination with embodiments of a method to feed and form organized groups of smoking articles, according to the present disclosure, that provides to vary, at least during the period when a specific blocked forming drawer 11 does not supply groups 19 of cigarettes 13 to the transfer conveyor with pockets 34, the speed at which the cigarettes are fed and transferred by means of the thrusters 41 to the others forming drawers 11, as will be described in greater detail in the following hereinafter.

In possible implementations, combinable with all the embodiments described herein, each pocket 36 of the transfer conveyor with pockets 34 can be provided with a sensor 36*a* (visible for instance in FIGS. 4*b* and 5*b* for example), configured to provide a signal correlated for instance to the presence or absence of the group 19 of cigarettes 13 inside it. For instance, the sensor 36*a* can be comprised in the electronic system controller 37. The control measurement can be useful if the pocket 36 is not filled with cigarettes, for example because there has been an obstruction, stoppage or blockage in the device 10, as explained in more detail hereafter. The sensor 36*a* can therefore be configured to supply a signal regarding the presence/absence of cigarettes to an electronic system controller of the apparatus 30. In possible embodiments, combinable with all the embodiments described herein, the signal generated by the sensor 36*a* can be used for instance to trigger a variation of the actuation speed of the thrusters 41 and thus of the speed at which the cigarettes are fed and transferred by means of the thrusters 41, for instance in case that one of the forming drawers 11 is blocked, as will be described in greater details hereinafter.

The above mentioned signal can be used also to start an automatic cleaning cycle of the device 10 to remove the obstruction, stoppage or blockage, as explained in more detail hereafter.

In possible implementations, the signal of the sensor 36*a* can be received by the electronic system controller 37 that can be configured to perform the above mentioned operations, i.e. variation of the feeding speed of the cigarettes in the forming drawers 11 that are not blocked, by varying the actuation speed of the independently actuated thrusters 41, and/or starting the automatic cleaning cycle of the device 10.

According to embodiments, combinable with all the embodiments described herein, the sensor 36*a* can be a proximity or presence sensor, for example. Possible proximity or presence sensors can be the inductive, capacitive, magnetic, ultrasound or optical type, for example. For example, a proximity or presence sensor of the optical type can be used, such as a photoelectric sensor or a photocell.

In possible implementations, the transfer conveyor with pockets 34 is configured to be driven step-wise, so as to position, with every step, an empty pocket 36 with its entrance facing the respective transfer device 10, receiving from it on each occasion the respective group 19 of cigarettes 13.

The transfer device 10 is therefore provided to connect, in the direction of transfer F of the cigarettes, the feed store 35, where the cigarettes are fed in a column as described above, to the pockets 36 of the transfer conveyor with pockets 34. The organized groups 19 of cigarettes 13 are made to pass, with an alternate thrust caused by the thrust unit 40, through the transfer device 10, arriving as we said in respective pockets 36 of the transfer conveyor with pockets 34.

The device 10 is therefore configured to connect the feed store 35 with the transfer conveyor with pockets 34. In particular, in the apparatus 30 in question, a device 10 according to the present description can be disposed between the feed store 35 and the transfer conveyor with pockets 34, aligned in the desired direction of transfer F.

In embodiments described here, the apparatus 30 includes a closing frame 38 provided to enclose, preventing access from outside at least during functioning, the transfer zone where the device 10 is disposed and the zone downstream, where there is the transfer conveyor with pockets 34. The closing frame 38 in practice makes the inside of the apparatus 30 inaccessible, at least during functioning, and also its components downstream of the feed store 35 in the direction of transfer F.

In possible embodiments, for example to increase the productivity of the apparatus 30, it can be provided to feed several groups 19 of cigarettes 13 in parallel from the feed store 35 toward respective pockets of the transfer conveyor with pockets 34, hence in different directions of transfer F, essentially parallel to each other. For example, with reference to FIGS. 10*a*, 10*b*, 11*a*, 11*b*, a plurality of feed sectors A, B, C can be provided, each associated with a respective thruster 41, forming drawer 11 and corresponding pocket 36 of the transfer conveyor with pockets 34.

In these embodiments, combinable with all the embodiments described herein, the transfer conveyor with pockets 34 is configured to be driven step-wise so as to present a mating plurality of pockets 36 on each occasion in cooperation with the forming drawers 11, and to fill the pockets 36 with groups 19 of cigarettes 13 moved by the thrusters 41. For example, in embodiments described using FIGS. 10*a*, 10*b*, 11*a*, 11*b*, and combinable with all the embodiments described herein, three feed sectors A, B, C can be provided, and three respective thrusters 41 actuated independently from each other by means of three respective actuators 48, to make the groups 19 of cigarettes 13 transit through three forming drawers 11 toward three respective pockets 36 presented by the transfer conveyor with pockets 34 driven step-wise.

Figure 2:
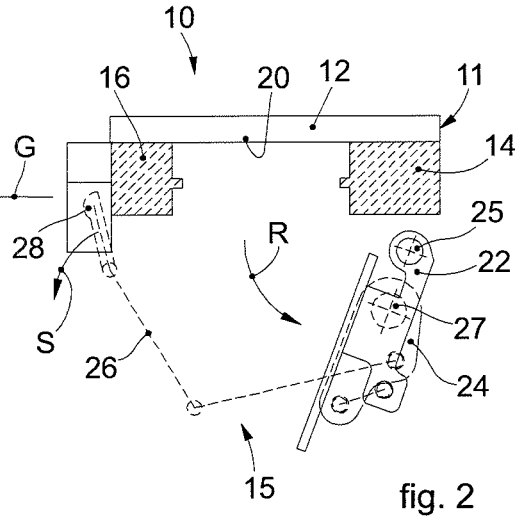
FIG. 2 is a schematic front view of a transfer device according to embodiments described here in a second maintenance condition.
Figure 3:
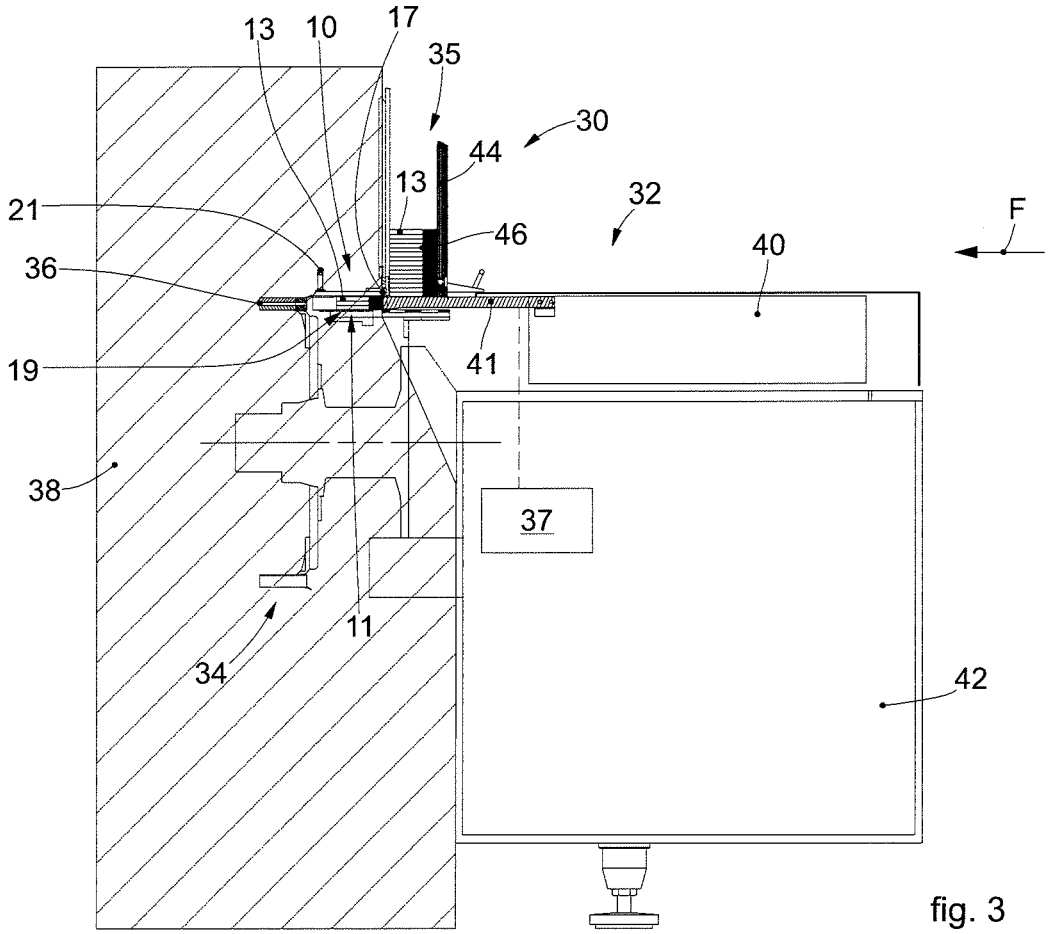
FIG. 3 is a schematic lateral view partly sectioned of an apparatus to feed and form organized groups of smoking articles comprising a transfer device in accordance with embodiments described here.
Figures 4A, 4B, 5A, 5B, 6:
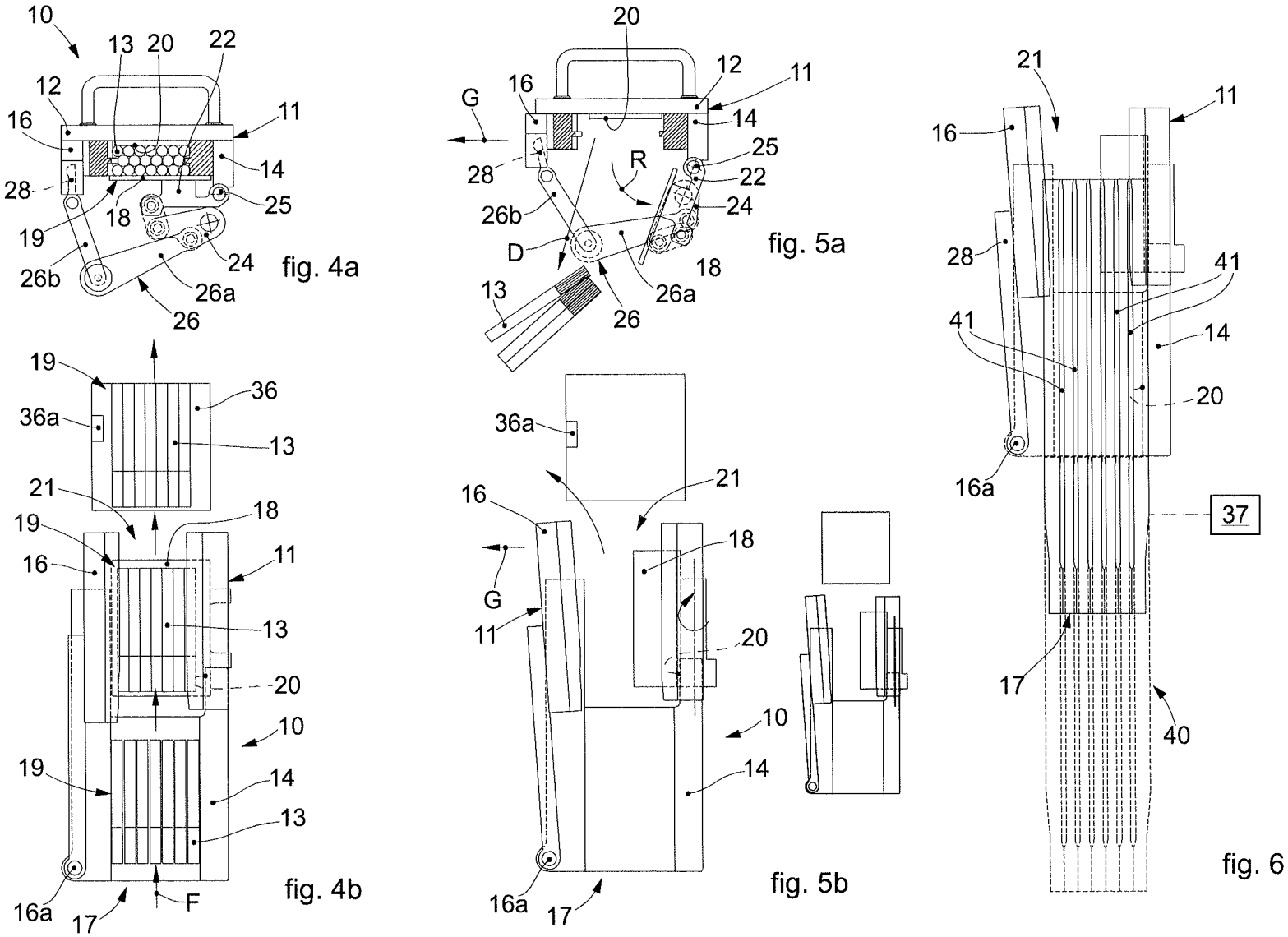
FIGS. 4*a* and 4*b* are schematic views, respectively a front view and a plan view from above, of a transfer device in accordance with embodiments described here in a first condition of use.
FIGS. 5*a* and 5*b* are schematic views, respectively a front view and a plan view from above, of a transfer device in accordance with embodiments described here in a second maintenance condition.
FIG. 6 is a schematic plan view from above, of a transfer device in accordance with embodiments described here associated with a thruster unit of an apparatus to feed and form organized groups of smoking articles.
Figure 7:
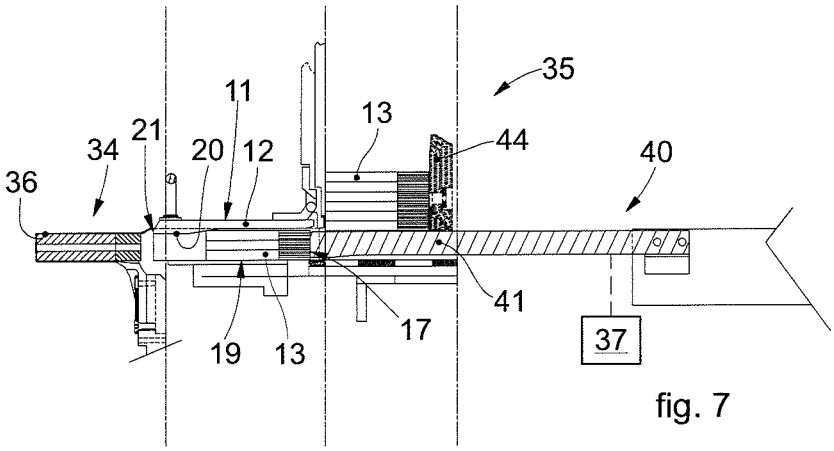
FIG. 7 is a schematic lateral view partly sectioned of a transfer device in accordance with embodiments described here in a first condition of use.
Figure 8:
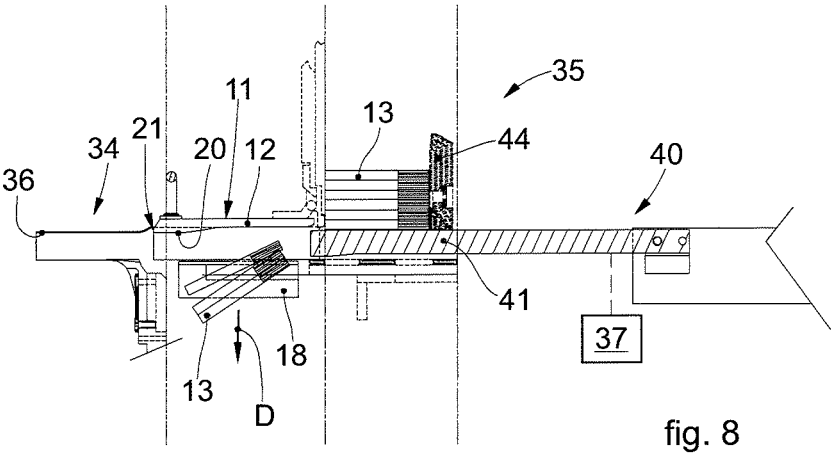
FIG. 8 is a schematic lateral view partly sectioned of a transfer device in accordance with embodiments described here in a second maintenance condition.

FIGS. 1 and 2 are used to describe embodiments of the device 10, comprising a forming drawer 11 provided with an upper wall 12, a first lateral wall 14, a second lateral wall 16 and a bottom wall 18. The forming drawer 11 is provided internally with a passage channel 20 for the transit of the cigarettes 13 in the direction of transfer F. In particular, the passage channel 20 develops longitudinally between an entrance 17 and an exit 21 in the direction of transfer F. In possible implementations, the upper wall 12, the first lateral wall 14, second lateral wall 16 and bottom wall 18 delimit internally the passage channel 20, at least in a normal transfer condition of the cigarettes 13. The cigarettes 13 are able to transit along the passage channel 20 in groups 19, and also the respective thrusters 41 which cooperate with the cigarettes 13.

The reciprocal position of the upper wall 12, the first lateral wall 14, second lateral wall 16 and bottom wall 18 defines an internal volume of the passage channel 20 mating with a respective volume of the group 19 of cigarettes 13 intended for one packet; in particular, the width of the internal volume of the passage channel 20 essentially coincides with the width of a group 19 of cigarettes 13.

For example, the upper wall 12, the first lateral wall 14, second lateral wall 16 and bottom wall 18 can be disposed orthogonal to each other, to define an essentially parallelepiped structure. In particular, the upper wall 12 and the bottom wall 18 can be disposed parallelly opposite each other, as are reciprocally the first lateral wall 14 and the second lateral wall 16.

The entrance 17 of the forming drawer 11 is provided facing the feed store 35, in particular the respective lateral exit apertures of the corresponding conduits of each feed zone, to receive the cigarettes 13. The exit 21 of the forming drawer 11 faces one of the pockets 36 of the transfer conveyor with pockets 34 which on each occasion are presented to receive the groups 19 of cigarettes 13. The cigarettes 13, being transferred from the feed store 35 toward a respective pocket 36 of the transfer conveyor with pockets 34, transit along the passage channel 20 in the direction of transfer F, from the entrance 17 to the exit 21. Generally, for example, when the device 10 and apparatus 30 are in use, obstructions or blockages can occur of the cigarettes 13 in transit along the passage channel 20, and consequently the group 19 of cigarettes 13 is not received by the specific pocket 36. This can be signaled to the electronic system controller by a signal indicating an absence of cigarettes 13 supplied by the sensor 36*a* of the pocket 36.

According to the present description, the upper wall 12 of the forming drawer 11 of the device 10 is disposed fixed in a position opposite the bottom wall 18. Furthermore, the bottom wall 18 of the forming drawer 11 of the device 10 is configured automatically mobile with respect to the fixed upper wall 12 between a closed position (see FIGS. 1, 4*a*, 4*b*, 10*a*, 10*b* for example) and an open position (see FIGS. 2, 5*a*, 5*b*, 8, 11*a*, 11*b* for example). This allows to automatically open the forming drawer 11 at the bottom, if obstructions or blockages of the cigarettes 13 are detected in the transit along the passage channel 20, causing the cigarettes 13 to fall, exit and be discharged, as shown by way of example by arrow D in FIGS. 5*a* and 9. The automatic opening of the bottom wall 18 can be triggered for example by the electronic system controller within a cleaning cycle started due to a signal indicating an absence of cigarettes 13 arriving from the sensor 36*a* provided in the specific pocket 36.

In particular, in the closed position the bottom wall 18 is configured to close the forming drawer 11 at the bottom, in this specific case the passage channel 20. In this way, a first condition of use of the device 10 is defined, in particular the normal transfer of the cigarettes 13, in which the cigarettes 13 can transit along the passage channel 20, thrust by the respective thruster 41, to reach the intended pocket 36 on the transfer conveyor with pockets 34 (FIGS. 1, 4*a*, 4*b*, 7, 10*a*, 10*b*). On the contrary, in the open position the bottom wall 18 is configured to open the forming drawer 11 at the bottom, in this specific case the passage channel 20. In this way a second condition of the device 10 is defined, in particular a maintenance condition, to free or release the passage channel 20 (FIGS. 2, 5*a*, 5*b*, 8, 11*a*, 11*b*), in particular allowing to remove the cigarettes 13 from the forming drawer 11, for example causing the cigarettes 13, or at least some of them, to fall due to gravity, since they are no longer supported at least from below by the bottom wall 18.

This allows to intervene automatically, for example in the event of obstruction, stoppage or blockage of the cigarettes 13 in transit, and to open the forming drawer 11 at the bottom, facilitating the fall by gravity of the cigarettes 13 and thus freeing the passage channel 20. This operation of passing from the normal transfer condition to the maintenance condition of the device 10 can therefore advantageously be performed automatically, without the manual intervention of an operator and without needing a direct intervention on the device 10. As we said, this operation can be started during a cleaning cycle triggered by a signal that there are no cigarettes 13, coming from the sensor 36*a* provided in the specific pocket 36.

This aspect is particularly advantageous in the case of a forming apparatus or packaging machine in which the transfer device 10 that connects the feed store 35 and the pockets and the transfer conveyor with pockets 34 are completely inaccessible, at least during functioning, from the outside in a closed and protected zone or area of the packaging machine as a whole, as in the case of the apparatus 30 described here where the closing frame 38 is provided for this purpose.

We must point out here that, in its passage from the first condition of use to the second maintenance condition, the device 10 always stays in the fixed position, aligned with the direction of transfer F, that is, it always stays parallel to itself. In particular, in both conditions of use, where as we said the bottom wall 18 is mobile to pass from one condition to the other, the upper wall 12 instead is always fixed and parallel to itself, in particular with respect to the direction of transfer F. Consequently, in both the first condition and the second maintenance condition, since the device 10 is in a fixed position, an operating connection is always provided and possible along a linear path defined by the direction of transfer F, through the passage channel 20, from the feed store 35 to the respective pocket 36 of the transfer conveyor with pockets 34. This makes it possible, also in the second maintenance condition where at least the bottom wall 18 is open downward to cause or facilitate the fall of the blocked cigarettes 13, to make the inside of the forming drawer 11 travel linearly to the respective thruster 41 with a desired alternate travel in the direction of transfer F, called cleaning travel, able to free or clean the passage channel 20 from the cigarettes 13 or their remaining detritus. The cleaning travel of the thruster 41 can be a partial travel inside the passage channel 20 and can be repeated according to needs. This possible intervention of alternate linear actuation in the direction of transfer F of a respective thruster 41 associated with the forming drawer 11 where an obstruction, stoppage or blockage of cigarettes 13 has formed can represent, in combination with the opening of the bottom wall 18, a further strategy whereby the passage channel 20 can be efficiently freed. In fact, the mechanical thrust action of the thruster 41 on the cigarettes 13 can easily cause the blocked cigarettes 13 or possible detritus to fall due to gravity, since the bottom wall 18 is open, also when the cigarettes 13, or their detritus, are compacted in the passage channel 20. The cleaning travel of the thruster 41 can also be activated, after the bottom wall 18 has been opened, within a cleaning cycle started due to a signal indicating an absence of cigarettes, arriving from the sensor 36*a* provided in the specific pocket 36.

In possible implementations, the bottom wall 18 can be mobile by rotation, that is, it can be horizontally pivoting around an axis of rotation to pass from the closed position to the open position and vice versa. In possible implementations, to be horizontally pivoting, the bottom wall 18 can be hinged by a respective first hinging member 25 associated with said axis of rotation. In possible implementations, the bottom wall 18 can be horizontally pivoting around an axis of rotation essentially parallel to said direction of transfer F, as indicated by arrow R (see FIGS. 2, 5*a* and 9). For example, the bottom wall 18 can be horizontally pivoting around an axis of rotation provided near the first lateral wall 14 (see FIGS. 1, 2, 4*a*, 4*b*, 5*a*, 5*b*, 7, 8, 9, 10*a*, 10*b*, 11*a*, 11*b* for example), that is, it can open by rotating downward from the side of the second lateral wall 16.

In other possible implementations, the bottom wall 18 can be mobile by linear translation, and is therefore moved linearly, for example in the horizontal plane at the side, or frontally or again toward the rear part of the forming drawer 11, or in the vertical plane, being lowered and raised, but in all these cases opening the forming drawer 11 at the bottom sufficiently to allow, or at least facilitate, the fall and exit of the cigarettes 13, thus freeing the passage channel 20 from obstructions and blockages.

According to some embodiments, combinable with all the embodiments described here, the device 10 includes a drive unit 15 configured to automatically drive at least the bottom wall 18, moving it from the closed position to the open position and vice versa. The drive unit 15 can be activated automatically by the electronic system controller within a cleaning cycle started due to a signal indicating an absence of cigarettes, arriving from the sensor 36*a* provided in the specific pocket 36.

To this purpose, in possible implementations, the drive unit 15 can also include a first drive member 22 connected to the bottom wall 18. The first drive member 22 can include the first hinging member 25. The first drive member 22 can include or be connected to an actuation element 22*a*. The actuation element 22*a* can include a drive member chosen from a group comprising: an electric motor, a step electric motor, a magnetic motor, a linear axle with a motor, a linear motor, such as a mechanical linear motor, a piezoelectric linear motor, an electromagnetic linear motor, an electromechanical motor, an electromagnet, a reduction gear, for example a direct current reduction gear. For example, motors can be provided that use electromagnetism and magnetic fields for interaction between a first part formed by electric coils and a second part formed by other electric coils, or by permanent or energized magnets or a conductor. In specific possible examples, the drive member can be configured as a linear motor, for example an induction linear motor, synchronous linear motor, brushless synchronous linear motor, homopolar linear motor, voice coil linear motor, tubular linear motor or also, as we said, a piezoelectric linear motor or an electromagnet. Usually, an actuation element, as used in association with embodiments described here, can be, if the bottom wall 18 is made to rotate, an intrinsically rotatory movement actuator, or be configured to convert a linear movement into a circular movement. On the contrary, if the bottom wall 18 is made to translate linearly, it can be provided to use an actuation element that is intrinsically linear or be configured to convert a circular movement into a linear movement.

The conversion can be commonly done by means of types of mechanism selected from a group consisting of: screw actuators, such as a jack screw, ball screw actuators and roll screw actuators, or wheel and axle, for example drum, gears, pulley or shaft, actuators such as a lifting cable, a winch, a rack and a pinion group, a chain transmission, a belt transmission, actuators with a rigid chain and a rigid belt.

According to some embodiments, combinable with all the embodiments described here, at least one of the lateral walls 14, 16 of the forming drawer 11 is configured automatically mobile laterally toward the outside with respect to the passage channel 20, in a direction of movement G essentially transverse to the direction of transfer F. In this way it is possible to laterally increase the volume of the passage channel 20, and the cigarettes 13 contained therein, no longer being compacted laterally, can be free to fall through gravity.

In possible implementations, the at least one lateral wall 14, 16 can be mobile by linear translation or by rotation. The rotation can be around an axis of rotation parallel to the direction of transfer F, or transverse thereto. For example, with reference to the embodiments described using FIGS. 4*a*, 4*b*, 5*a* and 5*b*, and in the case where the second lateral wall 16 is considered mobile for example, it is hinged around an axis of rotation perpendicular to the direction of transfer F by a hinging member 16*a*, to rotate toward the outside "wing-wise", remaining parallel to the forming drawer 11.

According to these embodiments therefore, the device 10, in its first condition of use described using FIGS. 1, 4*a*, 4*b*, 7, 10*a*, 10*b* has the lateral walls 14, 16 closed, while in the second maintenance condition described using FIGS. 2, 5*a*, 5*b*, 8, 11*a*, 11*b* it can have at least one of the lateral walls 14, 16 open, that is, displaced toward the outside.

In this way, the volume of the passage channel 20 is laterally increased, that is, increased with respect to the normal volume corresponding to the volume of a group 19 of cigarettes 13, so that this can facilitate the discharge of the cigarettes 13. This can be advantageous since the cigarettes 13 or their detritus, in the normal volume of the passage channel 20, can be compacted and possibly stick or adhere at least partly to the lateral walls 14, 16 and therefore, in some operating conditions, the opening of the bottom wall 18 may not be sufficient to guarantee the fall of all the cigarettes 13 possibly blocked or their detritus. On the contrary, by increasing the volume, at least in a lateral direction, of the passage channel 20, this disadvantage can be overcome, since a bigger space is created which, not retaining the cigarettes 13 or their detritus, allows them to fall.

In fact, the automatic lateral mobility toward the outside of at least one of the lateral walls 14, 16 allows to open, not only at the bottom thanks to the mobile bottom wall 18, but also at least one side of the forming drawer 11, increasing the internal volume so as to further facilitate the exit of the cigarettes 13. For example, with reference to the embodiments described by way of example using FIGS. 1, 2, 4*a*, 4*b*, 5*a*, 5*b*, 7, 8, 9, 10*a*, 10*b*, 11*a*, 11*b*, the second lateral wall 16 is mobile laterally toward the outside.

According to some embodiments, combinable with all the embodiments described here, the drive unit 15 can also be configured to determine the automatic movement, and hence the opening/closing, of the at least one laterally mobile lateral wall 14, 16, for example of the second lateral wall 16.

To this purpose, in possible implementations, the drive unit 15 can also include a second drive member 24. The second drive member 24 can include or be connected with an actuation element 24*a*. The actuation element 24*a* can be for example an actuation element as described with reference to the actuation element 22*a* included or connected with the first drive member 22.

In possible implementations, the second drive member 24 can be driven to act on the lateral wall 14 or 16 to be opened laterally. In particular, a system of levers can be provided in cooperation with the second drive member 24, to act on the lateral wall 14 or 16 to be opened. The system of levers can include an articulated return system 26 connected to a lever 28 able to act on the second lateral wall 16.

In possible implementations, the second drive member 24 can be rotatable, for example provided or associated with a second hinging member 27, to drive the articulated return system 26 which, by means of the lever 28 acts on the second lateral wall 16. The articulated return system 26 can comprise a double lever 26*a*, 26*b*, hinged on one side to a hinging portion of the second drive member 24 and on the other side to the lever 28.

For example, the lever 28 can be pivoted to be rotatable, as indicated by arrow S for example in FIG. 2, so as to thrust the lateral wall laterally toward the outside, in this specific case the second lateral wall 16, to open the forming drawer 11 laterally. The second hinging member 27 defines the axis of rotation around which the second drive member 24 can be rotated. The axis of rotation can be parallel to the direction of transfer F and provided on the opposite side to that where there is the lateral wall 14 or 16 to be opened. In this specific case, since the lateral opening toward the outside of the second lateral wall is described by way of example, the axis of rotation is provided on the opposite side, that is, on the side of the first lateral wall 14 and the direction of movement of the second drive member 24 can be indicated, in this case too, by arrow R, the direction of rotation of which is concordant with the direction of rotation of the lever 28 indicated by arrow S. The action of the lever 28, in this specific case by way of example, determines the movement toward the outside of the second lateral wall 16 by linear translation.

In other possible implementations, the second drive member 24 can be translatable linearly to drive the movement of the second lateral wall 16, for example using the lever 28.

According to possible implementations, the drive unit 15 can be configured to drive simultaneously both the bottom wall 18 and also the at least one lateral wall 14 or 16. For example, to this purpose the first drive member 22 and the second drive member 24 can be operatively connected to each other, so that the movement of one causes the movement of the other and consequently the mobility is simultaneously obtained of the bottom wall 18 and the second lateral wall 16. For example, to this purpose, it can be provided that the first drive member 22 and the second drive member 24 are associated with a common actuation element 22*a*, 24*a*.

It is clear that, although here we have described the opening of the second lateral wall 16, the same description can be applied if it is the first lateral wall 14 that is mobile laterally toward the outside.

Figure 9:
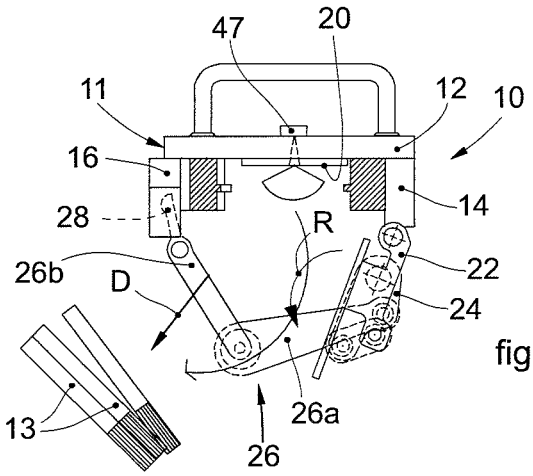
FIG. 9 is a schematic front view of a transfer device in accordance with other embodiments described here in a first condition of use.
Figure 11A:
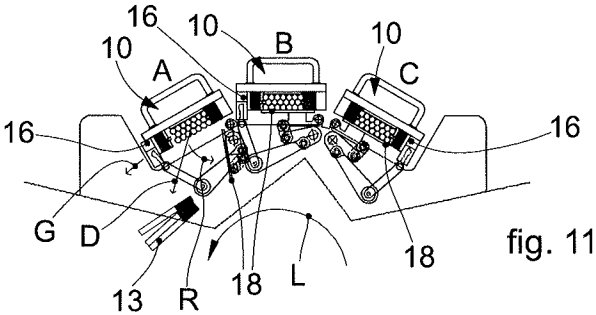
FIGS. 11*a* and 11*b* are schematic views, respectively a front view and a plan view from above, of a transfer device in accordance with embodiments described here in a second maintenance condition associated with thruster units of an apparatus to feed and form organized groups of smoking articles.
Figure 10A:
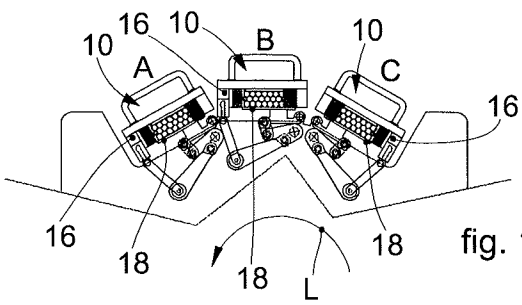
FIGS. 10*a* and 10*b* are schematic views, respectively a front view and a plan view from above, of a transfer device in accordance with embodiments described here in a first condition of use associated with thruster units of an apparatus to feed and form organized groups of smoking articles.
Figure 12:
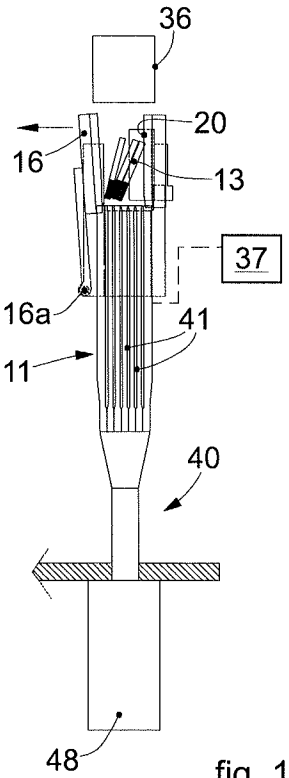
FIG. 12 is a schematic plan view from above of a transfer device in accordance with other embodiments described here.
Figure 11B:
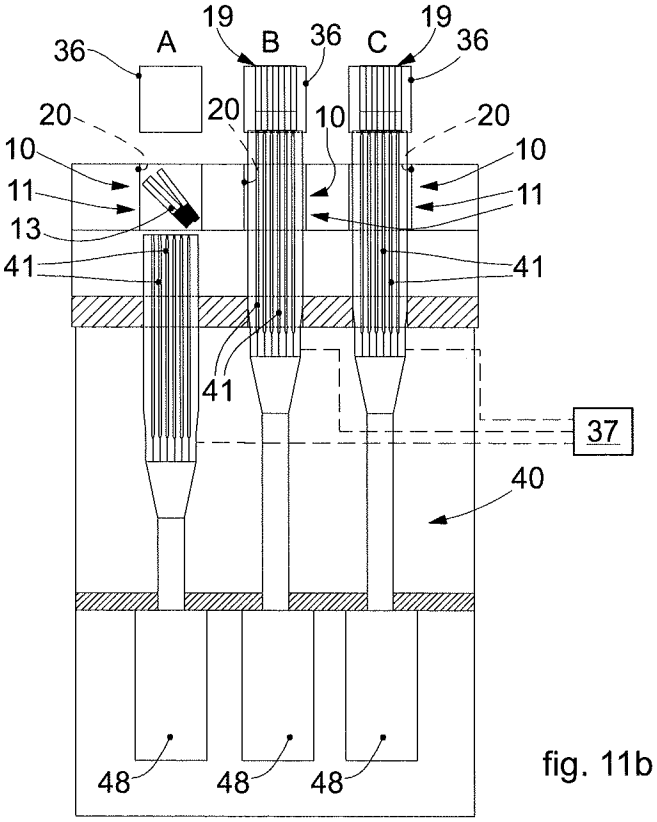
Figure 10B:
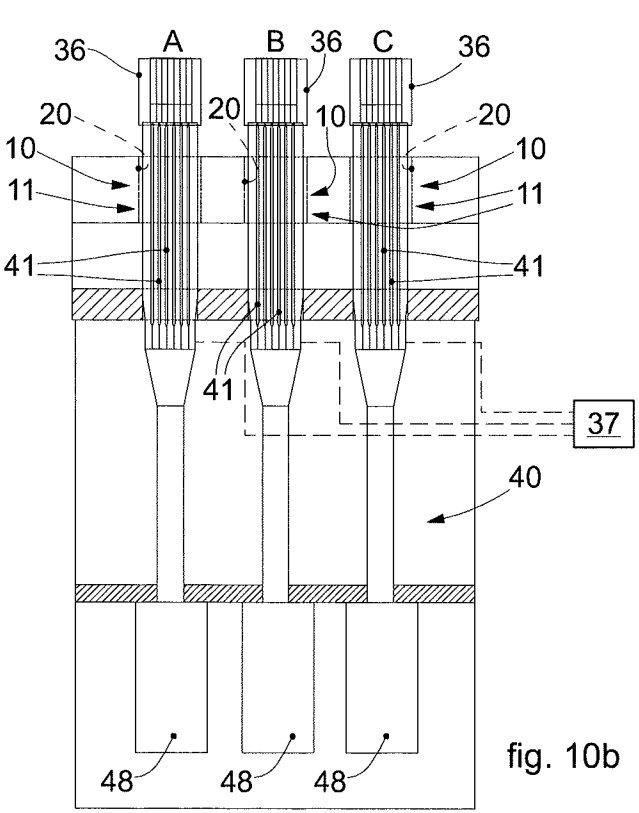

FIG. 9 is used to describe embodiments, combinable with all the embodiments described here, of the device 10, in which a unit for blowing compressed air 47 is provided, associated with the forming drawer 11 and configured to selectively emit a jet or puff of compressed air into the passage channel 20. For example, the jet of compressed air can be continuous or intermittent and can last a fraction of a second or up to several seconds. The duration can be predefined or selectable and/or adjustable according to needs. The activation of the unit for blowing compressed air 47 can also be triggered by the electronic system controller within a cleaning cycle started due to a signal indicating an absence of cigarettes 13, arriving from the sensor 36*a* of the pocket 36.

Providing the jet or puff of compressed air emitted by the unit for blowing compressed air 47 allows to assist, in the event of obstruction, stoppage or blockage in the passage channel 20, at least the action of opening the bottom wall 18, which leaves the cigarettes 13 free, that is, essentially without any support below. In substance, the jet or puff of compressed air functions as another strategy to clean the passage channel 20 of blocked cigarettes 13 or their detritus, at least helping the falling action caused by opening the bottom wall 18.

This embodiment can be combined, in particular, with the provision of lateral movement of one of the two lateral walls 14, 16 and/or with the provision of the cleaning travel performed by the respective thruster 41 along the passage channel 20. In the event of obstruction, stoppage or blockage of cigarettes 13 in the passage channel 20, for example following a signal indicating an absence of cigarettes 13 arriving from the sensor 36*a* provided in the specific pocket 36, a cleaning cycle can be activated automatically which can basically provide the stoppage of the thruster 41 and the opening of the bottom wall 18.

Additionally, the cleaning cycle can also provide the displacement of one of the two lateral walls 14, 16 which, as we said, can be simultaneous with the opening of the bottom wall 18 or sequential thereto. Furthermore, the cleaning cycle can also provide to re-activate the thruster 41 in order to perform, after at least the opening of the bottom wall 18 and possibly of one of the two lateral walls 14 or 16, at least a partial cleaning travel in the passage channel, possibly with the activation of the jet or puff of air by the compressed air blowing unit 47 (see FIGS. 6, 7, 8 and 9 for example).

Embodiments described using FIGS. 10*a*, 10*b*, 11*a*, 11*b* and 12 provide that, in the event of obstruction, stoppage or blockage of cigarettes 13 in a specific passage channel 20, indicated by a signal indicating an absence of cigarettes 13 arriving from the sensor 36*a* provided in the specific pocket 36, a cleaning cycle is automatically activated, which can be like the one described by way of example above, while the other passage channels 20, not obstructed, stopped or blocked, of the forming drawers 11, continue to feed the pockets 36 of the transfer conveyor with pockets 34, thanks to the action of the respective thrusters 41 actuated independently of each other.

Therefore, even in the event of obstruction, stoppage or blockage of cigarettes 13 in a forming drawer 11, the apparatus 30 can continue to operate with regard to the other forming drawers 11. In embodiments, combinable with all the embodiments described herein, the thrusters 41 are advantageously actuated independently of each other to thrust the respective groups 19 of cigarettes 13 and the transfer conveyor with pockets 34 is made to advance step-wise, presenting the pockets 36 to be filled sequentially in correspondence with the forming drawers 11 in which the transit of cigarettes 13 is regular and not blocked. For example, with reference to embodiments described using FIGS. 10*a*, 10*b*, 11*a* and 11*b*, we describe the possibility that the transfer conveyor with pockets 34 includes a transfer wheel rotating in the direction indicated by arrow L and that it continues to rotate step-wise even in the event of a blockage of one of the forming drawers 11. For example, according to possible embodiments, if the forming drawer 11 of the feed sector A is blocked, here the thruster 41 is stopped so as to proceed automatically with freeing the passage channel 20 by performing a cleaning cycle, while the other forming drawers 11 of the feed sectors B and C continue to operate, with the thrusters 41 that continue the alternate feed travel of the groups 19 of cigarettes 13 toward the pockets 36. This description can also be applied and adapted if the transfer conveyor with pockets 34 is the linear type.

In this way, the apparatus 30, the packaging or packet-making machines downstream of the transfer conveyor with pockets 34 can continue to operate, producing complete packets even in the event of a blockage of one of the forming drawers 11.

According to possible embodiments, combinable with all the embodiments described herein, the apparatus 30 can be configured so that, when one of the forming drawers 11 is obstructed, stopped or blocked, it is possible to vary, in particular to increase, at least during the period when the specific blocked forming drawer 11 does not supply groups 19 of cigarettes 13 to the transfer conveyor with pockets 34, the speed at which the cigarettes are fed and transferred, in this specific case by means of the thrusters 41 which can be actuated independently from each other as described above.

This is in order to keep constant, or as constant as possible, the quantity produced of groups 19 of cigarettes packaged, so that there is no slow-down in production caused by the blockage of one of the forming drawers 11.

In this way, in the event of a predefined and desired production rhythm in normal conditions in which all the forming drawers 11 are operating, it is possible to adapt and promote the actual productivity, in the event of a blocked forming drawer 11, so that it corresponds as much as possible and/or tends to the predefined and desired production rhythm.

To this purpose, the apparatus 30 can therefore provide a corresponding increase in the speed of feed of the thrusters 41 not affected by the blockage of the respective forming drawers 11 and the transfer conveyor with pockets 34. Advantageously, this is possible since the thrusters 41 can be actuated independently from each other as described above.

The speed of advance of the transfer conveyor with pockets 34 can therefore be kept at normal operating speed and, by increasing the speed of movement of the thrusters 41 not affected by the blockage or obstruction of the forming drawer 11, it is possible to fill, advantageously thanks to the independent actuation of each thruster 41 from each other thruster 41 as described above, all the pockets of the transfer conveyor with pockets 34, so as not to leave empty pockets or to make the transfer conveyor with pockets 34 and the packaging devices downstream advance in fits and starts.

Therefore, according to possible embodiments, combinable with all the embodiments described herein, the apparatus 30 comprises the plurality of thrusters 41 configured to be actuated independently from each other, in order to thrust the organized groups 19 of smoking articles 13, thus feeding the groups 19 of smoking articles 13, in the direction of transfer F and through respective forming drawers 11, into the pockets 36 on the basis of the predefined production rhythm. Independent actuation of each thruster with respect to the other can be achieved for instance by the above mentioned dedicated actuators 48, each connected to a specific thruster 47, as above described.

According to embodiments, which can be combined with all the embodiments described herein, the apparatus 30 comprises an electronic system controller 37 configured for commanding and controlling, in the event of obstruction, stoppage or blockage of a forming drawer 11, the variation of the operating speed of the independently actuated thrusters 41 associated with the other forming drawers 11 in coordination and in synchrony with the step-wise feed speed of said transfer conveyor with pockets 34, in order to obtain an effective production rhythm equal or near to said predefined production rhythm.

According to possible embodiments, combinable with all the embodiments described herein, a signal of obstruction, stoppage or blockage in a forming drawer 11 can be generated by the apparatus 30, in particular by the above mentioned sensor 36*a*, in the event of obstruction, stoppage or blockage of a forming drawer 11.

According to possible embodiments, combinable with all the embodiments described herein, the electronic system controller 37 associated with the apparatus 30 provides to manage the variation in the movement of the thrusters 41 when, for example, the signal of obstruction, stoppage or blockage in a forming drawer 11, for instance generated by the sensor 36*a* as above described, is received by the electronic system controller 37, and until the blocked forming drawer 11 is cleaned and the problem has been resolved.

These embodiments, which tend to maintain a high productivity even in the event of a blockage or obstruction of a forming drawer 11, can also be applied to an apparatus 30 provided with other types of transfer devices, different from the transfer device 10 described here.

It is clear that modifications and/or additions of parts may be made to the method and apparatus to feed and form organized groups of smoking articles as described heretofore, without departing from the field and scope of the present invention. It is also clear that, although the present invention has been described with reference to some specific examples, a person of skill in the art shall certainly be able to achieve many other equivalent forms of method and apparatus to feed and form organized groups of smoking articles, having the characteristics as set forth in the claims and hence all coming within the field of protection defined thereby.

The invention claimed is:

1. A method to feed and form organized groups of smoking articles, comprising:

providing a transfer conveyor having a plurality of pockets;

arranging the transfer conveyer to move the pockets in steps at a step-wise speed;

feeding the plurality of pockets using thrusters to thrust the organized groups in a direction of transfer through associated forming drawers;

arranging the thrusters to be actuated independently from each other;

moving the organized groups into the pockets on the basis of a predefined production rhythm; and when an obstruction, stoppage or blockage creates a blocked forming drawer, varying an operating speed of the thrusters associated with one or more unblocked forming drawers in coordination with and in synchrony with the step-wise feed speed of the transfer conveyor, so as to vary the speed at which the smoking articles are fed and transferred by the thrusters to the unblocked forming drawers;

thereby obtaining an effective production rhythm.

2. The method as in claim 1, wherein the varying of the operating speed of the thrusters is performed during a period when the blocked forming drawer is not supplying the organized groups to the transfer conveyor.

3. The method as in claim 1, wherein the varying of the operating speed of the thrusters increases the operating speed of the thrusters associated with the one or more unblocked forming drawers.

4. The method as in claim 1, including providing each forming drawer with a sensor, and wherein the sensor in the blocked forming drawer generates a signal, and wherein said signal is received by an electronic system controller which manages the varying of the operating speed of the thrusters.

5. The method as in claim 4, and further including starting a cleaning cycle for the blocked forming drawer in response to the signal being received by the electronic system controller.

6. The method as in claim 5, wherein each of said forming drawers has an upper wall and a bottom wall, and wherein in a first condition of use, each of said forming drawers operates to transfer the organized groups in a direction of transfer from a feed location to the pockets of the transfer conveyor, and wherein said cleaning cycle activates a second maintenance condition of said transfer device in which the upper wall of the blocked forming drawer is kept in a fixed position and at least the bottom wall of the blocked forming drawer is automatically opened to allow the removal of a blockage from said blocked forming drawer.

7. The method as in claim 6, wherein the smoking articles, in the first condition of use, move in said direction of transfer in a passage channel provided inside each of the plurality of forming drawers, wherein said passage channel is kept aligned to said direction of transfer both in the first condition of use and in the second maintenance condition.

8. The method as in claim 7, wherein, in said second maintenance condition, at least one of the lateral walls delimiting laterally said passage channel is automatically moved laterally outward with respect to the passage channel in a direction of movement transverse to the direction of transfer.

9. The method as in claim 7, wherein, in said second maintenance condition, after the bottom wall has been opened, a thruster of smoking articles is activated for a cleaning travel inside the passage channel.

10. The method as in claim 7, wherein, in said maintenance condition, after the bottom wall has been opened, a jet of compressed air is introduced inside the passage channel.

11. The method as in claim 1, wherein the operating speed of the thrusters is varied until the blocked forming drawer is cleaned.

12. An apparatus to feed and form organized groups of smoking articles, wherein said apparatus comprises:

a transfer conveyor with pockets moved step-wise and provided with a plurality of pockets, forming drawers associated with said pockets, a plurality of thrusters configured to be actuated independently from each other, in order to thrust said organized groups of smoking articles, thus feeding said groups of smoking articles, in a direction of transfer and through respective forming drawers, into said pockets on the basis of a predefined production rhythm, an electronic system controller configured for commanding and controlling a variation of an operating speed of the plurality of thrusters, the variation of the operating speed arranged to, in the event of an obstruction, stoppage or blockage creating a blocked forming drawer, vary the operating speed of thrusters associated with one or more unblocked forming drawers so as to vary the operating speed at which the organized groups are fed and transferred by the thrusters to the unblocked forming drawers in coordination and in synchrony with the step-wise feed speed of said transfer conveyor, thereby obtaining an effective production rhythm equal or near to said predefined production rhythm.

13. A method to feed and form organized groups of smoking articles, comprising:

providing a transfer conveyor having a plurality of pockets;

arranging the transfer conveyer to move the pockets in steps at a step-wise speed;

feeding the plurality of pockets using thrusters to thrust the organized groups in a direction of transfer through associated forming drawers;

arranging the thrusters to be actuated independently from each other;

moving the organized groups into the pockets on the basis of a predefined production rhythm; and in the event of a blocked forming drawer, varying an operating speed of the thrusters associated with one or more unblocked forming drawers in coordination with and in synchrony with the step-wise feed speed of the transfer conveyor;

providing each forming drawer with a sensor, and wherein the sensor in the blocked forming drawer generates a signal;

starting a cleaning cycle for the blocked forming drawer in response to the signal being received by an electronic system controller; and wherein each of said forming drawers has an upper wall and a bottom wall, and wherein, in a first condition of use, each of said forming drawers operates to transfer the organized groups in a direction of transfer from a feed location to the pockets of the transfer conveyor, and wherein said cleaning cycle activates a second maintenance condition of said transfer device in which the upper wall of the blocked forming drawer is kept in a fixed position and at least the bottom wall of the blocked forming drawer is automatically opened to allow the removal of a blockage from the blocked forming drawer.

14. The method as in claim 13, including electronically varying the operating speed of the thrusters.

* * * * *